United States Patent [19]

Thal

[11] Patent Number: 4,744,691

[45] Date of Patent: May 17, 1988

[54] ANCHORING MEANS FOR TENSION MEMBERS

[75] Inventor: Hermann Thal, Mondsee, Austria

[73] Assignee: Vorspann-Technik Gesellschaft m.b.H., Salzburg, Austria

[21] Appl. No.: 836,385

[22] Filed: Mar. 5, 1986

[30] Foreign Application Priority Data

Mar. 5, 1985 [AT] Austria ..... 646/85

[51] Int. Cl.[4] ..... B25G 3/20; F16B 2/14

[52] U.S. Cl. ..... 403/374; 52/223 L; 24/136 R

[58] Field of Search ..... 403/374, 266, 268, 267; 24/136 R, 122.6; 52/223 L

[56] References Cited

U.S. PATENT DOCUMENTS

| | | | |
|---|---|---|---|
| 1,529,734 | 3/1925 | Barbour et al. | 24/136 R |
| 3,778,869 | 12/1973 | Andrews | 403/374 X |
| 4,027,359 | 6/1977 | Tinker | 24/136 R X |
| 4,367,568 | 1/1983 | Weiser | 403/374 X |
| 4,454,633 | 6/1984 | Fuente et al. | 24/122.6 X |
| 4,494,890 | 1/1985 | Lusk | 403/267 |
| 4,585,368 | 4/1986 | Pagan | 403/266 |
| 4,589,796 | 5/1986 | Newling | 403/374 |

FOREIGN PATENT DOCUMENTS

| | | | |
|---|---|---|---|
| 233785 | 5/1964 | Austria . | |
| 2515423 | 11/1975 | Fed. Rep. of Germany . | |
| 102845 | 6/1983 | Japan | 24/122.6 |
| 2136073 | 9/1984 | United Kingdom | 52/223 L |
| 617646 | 7/1978 | U.S.S.R. | 403/374 |
| 1057655 | 11/1983 | U.S.S.R. | 52/223 L |

*Primary Examiner*—Andrew V. Kundrat

*Attorney, Agent, or Firm*—Fleit, Jacobson, Cohn & Price

[57] ABSTRACT

Anchoring means for anchoring tension members, more especially for anchoring tension cable conductors, comprises at least two clamping components in the form of anchoring wedges which are disposed one behind the other on the tension member and are anchored in at least one anchoring member. The moulding which is more remote from the support structure is harder than, or as hard as, the tension member, while the clamping component which is nearer the support structure is softer than the tension member. The tension member is initially tensioned, then the anchoring wedge of the first anchoring member is pressed in position by the insertion of an intermediate member between the first and second anchoring members; meanwhile, the first anchoring member is supported on the second anchoring member by the intermediate member; then the intermediate member is removed, and subsequently the anchoring wedge of the second anchoring member is pressed in position by the first anchoring member.

9 Claims, 5 Drawing Sheets

ANCHORING MEANS FOR TENSION MEMBERS

BACKGROUND OF THE INVENTION

The present invention relates to anchoring means for anchoring tension members, more especially for anchoring tension cable strands or tension rods, whereby at least one tension member is anchored in an anchoring member by means of a gripping or pressing component which grips the cable or rod.

A conventional anchoring member is in the form of a conical ring which has inserted therein an annular wedge i.e. a tapered collar, which is comprised of at least two portions, the inner wall of said wedge being serrated. When the annular wedge is pressed in position, the serration of the inner wall presses into the surface of the tension member and produces indentations. When the tension member is in its tensioned state, it is quite possible that, because the cross-sectional area is reduced at the indentations, the tension member may break at these locations when considerable, static stresses occur for a short time or when prolonged, dynamic loads are applied.

The invention seeks to provide an anchoring means and a method of providing or installing such a means which overcomes, or reduces to a minimum, the above-mentioned risk of the tension member breaking prematurely.

SUMMARY OF THE INVENTION

According to the present invention there is provided anchoring menas for tension members, more especially for use in tensioning one or more cables or rods against support means whereby at least one tension member is anchored in an anchoring member by means of a gripping or clamping component, characterised in that the tension member is anchored in at least one anchoring member by means of at least two pressing or clamping components which are disposed one behind the other along the tension member and have the tension member extending therethrough, the clamping component which is more remote from the support means such as a main structure or building being harder than, or as hard as, the tension member, and the clamping component which is nearer the support means or main structure or building being softer than the tension member.

The clamping component nearer the support means is advantageously made of plastics material or soft metal. The term "soft metal" is used to describe a metal which is softer than the tension member, for example, a non-hardened steel.

In one arrangement of the invention, a layer of plastics material or soft metal is provided on the inner surface of the clamping component which is nearer the support means or main structure.

According to a first embodiment, the anchoring means includes a first anchoring member, which is more remote from the support means, and a second anchoring member, which is nearer the support means, the clamping components being in the form of anchoring wedges.

According to a second embodiment, the anchor means includes a one-piece anchoring member, and at least the clamping component which, in use, is more remote from the support means is in the form of an anchoring wedge. In this embodiment, the clamping component which is nearer the support means either has a cylindrical shape or is in the form of an anchoring wedge with the tip of its point or, when conical, its cone being orientated away from the support means.

A method of providing or installing an anchoring means in accordance with the first embodiment of the invention is characterised in that the tensioning member is initially tensioned, then the anchoring wedge of the first anchoring member is pressed in position by the insertion of an intermediate member between the first and second anchoring members; meanwhile, the first anchoring member is supported on the second anchoring member by the intermediate member; the intermediate member is then removed, and subsequently the anchoring wedge of the second anchoring member is pressed in position by the first anchoring member.

A method of providing or installing an anchoring means in accordance with the second embodiment of the invention is characterised in that the tensioning member is initially tensioned, then the anchoring wedge is pressed into the anchoring member by the insertion of an intermediate member between the anchoring member and an anchoring plate; meanwhile, the anchoring member is supported on the anchoring plate by the intermediate member; the intermediate member is then removed, and subsequently the cylindrical clamping component or the anchoring wedge, respectively, is pressed in position by the anchoring member.

BRIEF DESCRIPTION OF THE DRAWINGS

The invention will be described further, by way of example, with reference to the accompanying drawings wherein a plurality of embodiments are illustrated and in which.

DESCRIPTION OF THE PREFERRED EMBODIMENTS

Figure 1:
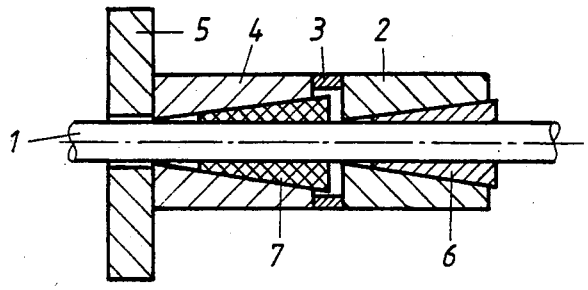
FIGS. 1 to 3 illustrate a first embodiment of an anchoring means during the tensioning and pressing operations, respectively.

In FIG. 1, a tensioning or tension member 1 is in the form of a stranded tension cable, a tension wire, or a similar tension means. A first anchoring member 2 is in the form of a conical ring which is supported on a second anchoring member 4 by an intermediate member 3 which is in the form of a two-piece supporting ring; said second anchoring member 4 also being in the form of a conical ring and being supported on an anchoring plate 5. Anchoring or gripping wedges 6 and 7 are in the form of tapered collars, which may be pressed or moulded, and are inserted in the first and second anchoring members 2 and 4, respectively.

Figure 2:
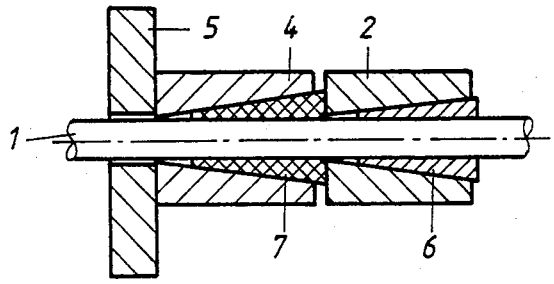
Figure 3:
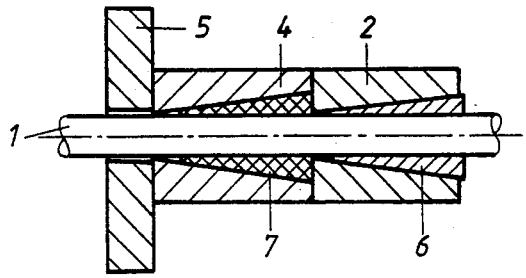

The anchoring means is produced in such a manner that the tension member 1 is initially tensioned, then the anchoring wedge 6 is pressed into the first anchoring member 2; meanwhile, the first anchoring member 2 is supported on the anchoring member 4 by the intermediate member 3. The tension member 1 is retensioned and two-piece intermediate member 3 may thereby be removed since the first anchoring member 2 moves some distance from the intermediate member 3. The tension member 1 is subsequently relieved of tension, so that the first anchoring member 2 abuts initially against the anchoring wedge 7 of the second anchoring member 4, as shown in FIG. 2; whereupon, by further relieving the tension member 1 of tension, the anchoring wedge 7 is pressed into the second anchoring member 4 by the first anchoring member 2 until the first anchoring member 2 lies directly on the second anchoring member 4, as shown in FIG. 3. The pressing-in operation may also be effected, or assisted, mechanically by means of a pressing device. If necessary, however, a small spacing may also be maintained between the two anchoring members 2 and 4; i.e. in its final position, the first anchoring member 2 may be supported against the anchoring wedge 7 of the second anchoring member 4. During the pressing-in operation, the softer material of the anchoring wedge 7 passes, i.e. "flows", into the cavities formed between the tensioning cable strands.

Figure 4:
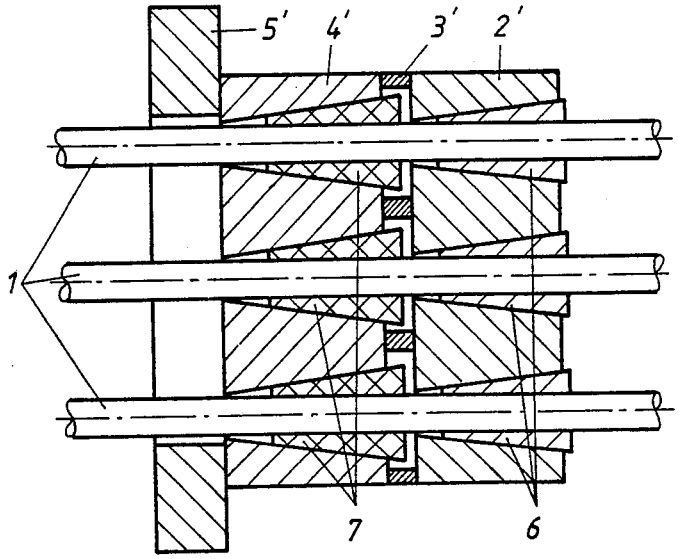
FIGS. 4 to 6 illustrate a second embodiment of an anchoring means during the tensioning and pressing operations, respectively.
Figure 5:
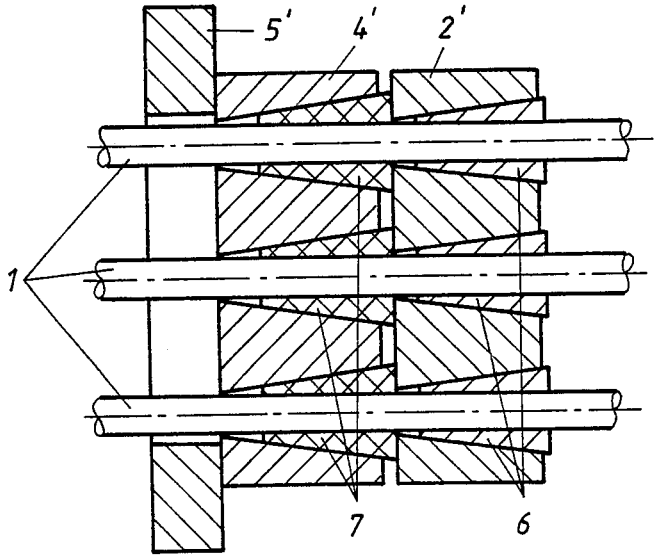
Figure 6:
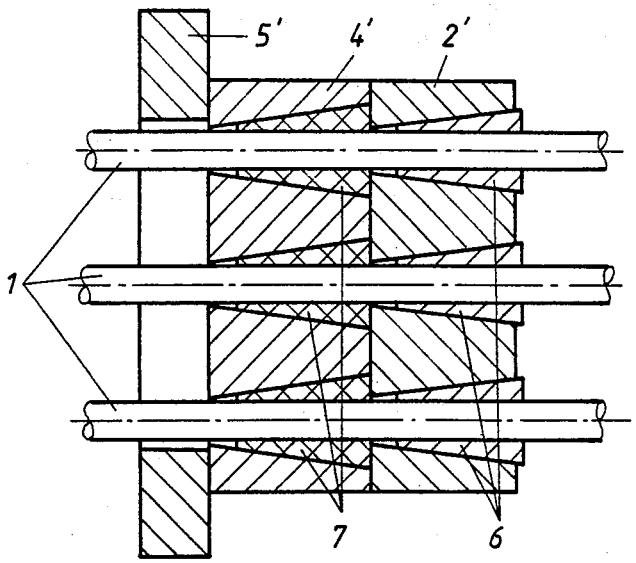

In the second embodiment as illustrated in FIGS. 4 to 6, three tension members 1 are provided. The anchoring members 2' and 4' accordingly have three respective, conically tapering apertures into which the anchoring wedges 2' and 4' are inserted. Consequently, the intermediate member 3' also has three apertures. The anchoring plate 5' has only one aperture for the three tensioning members 1 to pass therethrough.

The anchoring operation is effected in the same way as with the first embodiment, i.e. the installation phases shown in FIGS. 4, 5 and 6 correspond to those shown in FIGS. 1 to 3.

Figure 7:
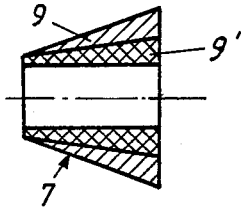
FIGS. 7 and 8 illustrate two examples of anchoring wedges.
Figure 8:
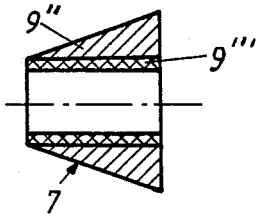

The material used for the anchoring wedges 7 of the second anchoring member 4 and 4', respectively, is preferably of plastics material or soft metal, the term "soft metal" being used to describe a metal which is softer than the tensioning member—a non-hardened steel, for example. The anchoring wedges shown in FIGS. 7 and 8 are partially made of plastics material or soft metal. FIG. 7 illustrates a conical inner portion 9' which is made of plastics material or soft metal and is surrounded by a conical outer portion 9. FIG. 8 illustrates a cylindrical inner portion 9''' which is made of plastics material or soft metal and is surrounded by a conical outer portion 9''. The inner portions 9', 9''' and the outer portions 9, 9'' may either be telescoped one inside the other in a loose manner or be interconnected, for example, by means of bonding e.g. adhesive. It is also possible to draw over the tension member 1 a sleeve which is made of plastics material or soft metal and corresponds to the shape of the inner portion 9' or 9''' respectively. The outer portion 9 or 9'' respectively, then being mounted on said sleeve.

Figure 9:
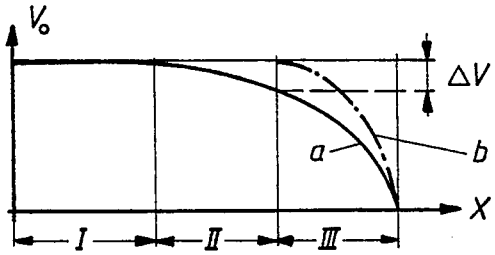
FIG. 9 is a diagram illustrating the development of the tension along the tension member.

FIG. 9 is a diagram illustrating the development of the tension $V_O$ along the tension member 1 with respect to its longitudinal axis X. I denotes the free region of the tension member 1, II denotes the region within the second anchoring member 4; and III denotes the region within the first anchoring member 2. It is evident that the tension within the second anchoring member 4 decreases by $\Delta$ V, and the tension within the first anchoring member 2 is reduced to zero (curve a). Curve b, which is shown by a dotted line, indicates the development of the tension which would occur if only the first anchoring member 2 were provided. Due to the provision of the second anchoring member 4 in front of the first anchoring member 2, the tension is reduced from $\Delta$% to $\Delta$ V. This arrangement provides an increase, by a considerable amount, in the expansion of the tension member with static loading and the maximum possible increase in the breaking load. With dynamic loading, the fatigue strength is considerably increased, i.e. the alternating stress $\Delta\ \sigma$ increases. The durability of the tension member which is anchored in this manner corresponds almost to the loading of the tension member which is undisturbed by the anchoring operation. The anchoring means is especially suitable for use with inclined cable bridge constructions.

Figure 10:
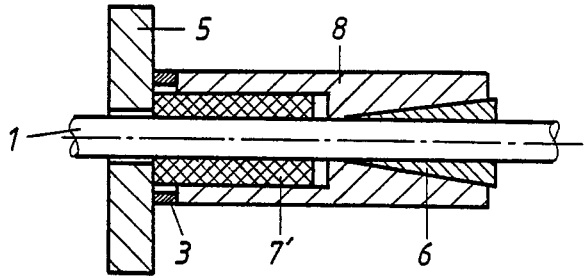
FIGS. 10 to 12 illustrate a third embodiment of an anchoring means during the tensioning and pressing operations, respectively.
Figure 11:
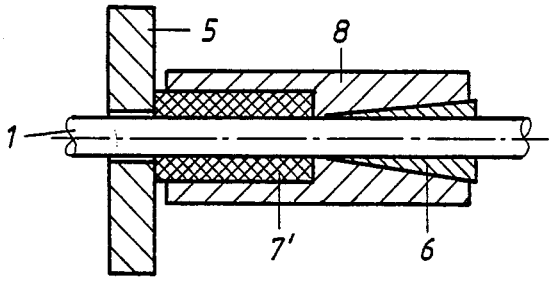
Figure 12:
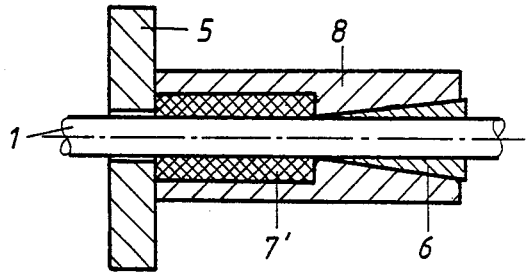

In the third embodiment as illustrated in FIGS. 10 to 12, the clamping component 7' has a cylindrical shape and is disposed in a one-piece anchoring member 8 as is the anchoring wedge 6. An intermediate member 3, in the form of a two-piece supporting ring, is provided between the anchoring member 8 and the anchoring plate 5.

The anchoring is effected in such a manner that the tensioning member 1 is initially tensioned, then the anchoring wedge 6 is pressed into the anchoring member 8, while the latter member 8 is supported on the anchoring plate 5 by the intermediate member 3. The intermediate member 3 is then removed upon re-tensioning of the tensioning member 1 whenever the anchoring member 8 moves some distance from the intermediate member 3. The tensioning member 1 is subsequently relieved of tension, so that the anchoring member 8 abuts initially against the end face of the cylindrical clamping component 7', as shown in FIG. 11; whereupon, by further relieving the tensioning member 1 of tension, the clamping component 7' is pressed into the anchoring member 8 or into cavities formed in the tension member 1, respectively, until the anchoring member 8 lies directly on the anchoring plate 5, as shown in FIG. 12. The pressing-in operation may also be effected, or assisted, mechanically by means of a pressing device. If necessary, however, a small spacing may remain between the anchoring member 8 and the anchoring plate 5, so that the anchoring member 8 is supported in its final position against the anchoring plate 5 by the clamping component 7'.

Figure 13:
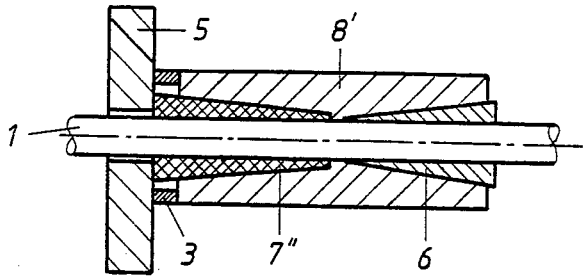
FIGS. 13 to 15 illustrate a fourth embodiment of an anchoring means during the tensioning and pressing operations, respectively.
Figure 14:
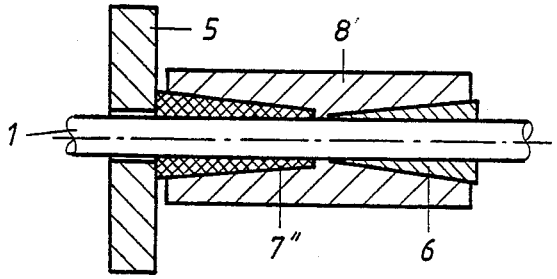
Figure 15:
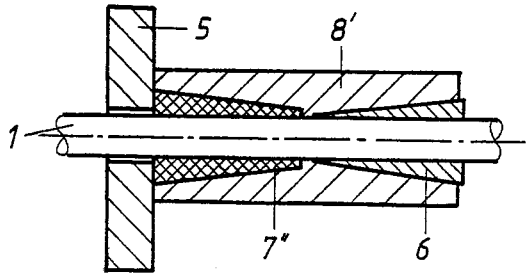

In the fourth embodiment as illustrated in FIGS. 13 to 15, the clamping component is in the form of anchoring wedge 7'', but the tip of its cone is orientated away from the anchoring plate 5 or building.

The anchoring means is produced in the same way as with the third embodiment, so it is considered there is no need to describe it again. It is self-evident that the embodiments of the clamping components or anchoring wedges shown in FIGS. 7 and 8 may also be used for the embodiments shown in FIGS. 10 to 12 and 13 to 15, respectively, and that these embodiments may also be used for a plurality of tension members, just like those shown in FIGS. 4 to 6.

I claim:

1. An anchor comprising:

an anchoring support having a passage, a first anchoring member having a passage extending therethrough and being movable towards said anchoring support, a second anchoring member having a passage extending therethrough, said second anchoring member being positioned closer to said anchoring support than said first anchoring member so as to be against said anchoring support, a tension member extending successively through said passage of said anchoring support, said passage of said second anchoring member and said passage of said first anchoring member, a first clamping component having a passage extending therethrough, said first clamping component being located in said passage of said first anchoring member and said tension member passing through said passage of said first clamping component, a second clamping component having a passage extending therethrough, said second clamping component being located in said passage of said second anchoring member and said tension member passing through said passage of said second clamping component, and means to ensure that upon tensioning of said tension member to draw said first clamping component and said second clamping component toward said anchoring support, said first clamping component engages said first anchoring member and both said first anchoring member and said first clamping component move so as to press said first anchoring member against said second clamping component to engage said second clamping component with said second anchoring member.

2. An anchor according to claim 1, wherein said second clamping component is made of a material softer than said tension member.

3. An anchor according to claim 2, wherein said material is a plastics material.

4. An anchor according to claim 2, wherein said material is a metal.

5. An anchor according to claim 1, wherein said first clamping component is made of a material at least as hard as said tension member.

6. An anchor according to claim 1, wherein a plastics material lines said passage of said second clamping component.

7. An anchor according to claim 1, wherein metal lines said passage of said second clamping component.

8. An anchor according to claim 1, wherein said first clamping component and said second clamping component are wedge shaped.

9. An anchor comprising:

an anchoring support having a passage, at least one anchoring member having a passage extending therethrough, at least two clamping components having a passage extending therethrough, said at least two clamping components being located in said passage of said at least one anchoring member, a tensioning member extending through said passage of said at least one anchoring member and said passage of said at least two clamping components, one clamping component of said at least two clamping components being located closer to said anchoring support than another clamping component of said at least two clamping components and being of a material softer than said tension member and said another clamping component being of a material at least as hard as said tension member so that said at least two clamping components effect a clamping action on said tension member during tensioning of said tension member.

* * * * *